US005146904A

United States Patent [19]

Olson et al.

[11] Patent Number: 5,146,904

[45] Date of Patent: Sep. 15, 1992

[54] INTERNAL COMBUSTION ENGINE FUEL SUPPLY SYSTEM

[75] Inventors: Jeffrey A. Olson, Vernon Hills; Donald Custer, Jr., Grayslake, both of Ill.

[73] Assignee: Outboard Marine Corporation, Waukegan, Ill.

[21] Appl. No.: 718,008

[22] Filed: Jun. 20, 1991

[51] Int. Cl.[5] ..... F02M 67/12

[52] U.S. Cl. ..... 123/533; 123/531; 239/410

[58] Field of Search ..... 123/531-533; 239/408, 409, 410, 533.2, 533.8

[56] References Cited

U.S. PATENT DOCUMENTS

| | | | |
|---|---|---|---|
| 1,363,470 | 12/1920 | Knudsen | 239/405 |
| 1,586,006 | 5/1926 | Rochefort | 239/410 |
| 1,616,335 | 2/1927 | Rochefort | 239/412 |
| 1,793,154 | 2/1931 | Bellem et al. | 239/410 |
| 2,029,774 | 2/1936 | Harris | 48/94 |
| 2,086,664 | 7/1937 | Fels | 239/410 |
| 2,697,007 | 12/1954 | Wille | 239/88 |
| 2,965,311 | 12/1960 | Gascoigne | 239/403 |
| 3,656,693 | 4/1972 | Eckert | 239/410 |
| 4,771,754 | 9/1988 | Reinke | 123/533 |
| 4,781,164 | 11/1988 | Seeber et al. | 123/533 |
| 4,856,713 | 8/1989 | Burnett | 239/113 |

*Primary Examiner*—Tony M. Argenbright

*Attorney, Agent, or Firm*—Michael, Best & Friedrich

[57] ABSTRACT

An internal combustion engine comprising structure defining a combustion chamber, structure defining a fuel/air chamber adapted to communicate with a source of air under pressure, structure defining an air chamber, structure for opening the fuel/air chamber to the combustion chamber in response to communication of the air chamber with the air source, structure for effecting communication between the air chamber and the air source in response to delivery of fuel to the fuel/air chamber, and selectively operable structure for delivering fuel to the fuel/air chamber.

24 Claims, 2 Drawing Sheets

INTERNAL COMBUSTION ENGINE FUEL SUPPLY SYSTEM

BACKGROUND OF THE INVENTION

The invention relates to fuel supply systems for internal combustion engines. More particularly, the invention relates to fuel injection systems and, still more particularly, to fuel injection systems for two-stroke internal combustion engines.

The invention also relates to arrangements for injecting a fuel/gas mixture into the air intake system or combustion chamber of an internal combustion engine. Furthermore, the invention relates to arrangements for injecting a mixture of compressed gas and fuel into the combustion chamber of an internal combustion engine.

SUMMARY OF THE INVENTION

The invention provides an internal combustion engine comprising means defining a combustion chamber, means defining a fuel/air chamber adapted to communicate with a source of air under pressure, means including a moveable wall defining a fuel chamber, selectively operable means for supplying fuel to the fuel chamber at a pressure sufficient to move the wall in the direction increasing the volume of the fuel chamber, means defining a fuel orifice which is spaced from the wall and which communicates between the fuel chamber and the fuel/air chamber, and means for opening the fuel/air chamber to the combustion chamber in response to movement of the wall in the direction increasing the volume of the fuel chamber.

One embodiment of the invention provides an internal combustion engine comprising means defining a combustion chamber, means defining a fuel/air chamber adapted to communicate with a source of air under pressure, means defining an air chamber, means for opening the fuel/air chamber to the combustion chamber in response to communication of the air chamber with the air source, means for effecting communication between the air chamber and the air source in response to delivery of fuel to the fuel/air chamber, and selectively operable means for delivering fuel to the fuel/air chamber.

One embodiment of the invention provides a fuel supply system for an internal combustion engine including a combustion chamber, the system comprising means defining a fuel/air chamber adapted to communicate with a source of air under pressure, means including a moveable wall defining a fuel chamber, selectively operable means for supplying fuel to the fuel chamber at a pressure sufficient to move the wall in the direction increasing the volume of the fuel chamber, means defining a fuel orifice which is spaced from the wall and which communicates between the fuel chamber and the fuel/air chamber, and means for opening the fuel/air chamber to the combustion chamber in response to movement of the wall in the direction increasing the volume of the fuel chamber.

One embodiment of the invention provides a fuel supply system for an internal combustion engine including a combustion chamber, the system comprising means defining a fuel/air chamber adapted to communicate with a source of air under pressure, means defining an air chamber, means for opening the fuel/air chamber to the combustion chamber in response to communication of the air chamber with the air source, means for effecting communication between the air chamber and the air source in response to delivery of fuel to the fuel/air chamber, and selectively operable means for delivering fuel to the fuel/air chamber.

One embodiment of the invention provides a fuel supply system for an internal combustion engine including a combustion chamber, the system comprising means defining a fuel/air chamber adapted to communicate with a source of air under pressure, means defining a first valve seat, a first valve member moveable into and out of engagement with the first valve seat, a first moveable wall partially defining an air chamber, and means for opening the fuel/air chamber to the combustion chamber in response to communication of the air chamber with the air source, the means for opening the fuel/air chamber including means for moving the first valve member out of engagement with the first valve seat in response to movement of the first wall in the direction increasing the volume of the air chamber, the system also comprising means defining a second valve seat, a second valve member moveable into and out of engagement with the second valve seat, a second moveable wall partially defining a fuel chamber communicating with the fuel/air chamber, and means for effecting communication between the air chamber and the air source in response to delivery of fuel to the fuel chamber, the means for effecting communication between the air chamber and the air source including means for moving the second valve member out of engagement with the second valve seat in response to movement of the second wall in the direction increasing the volume of the fuel chamber, and the system also comprising selectively operable means for delivering fuel to the fuel chamber.

Other features and advantages of the invention will become apparent to those of ordinary skill in the art upon review of the following detailed description, claims, and drawings.

Figure 2:
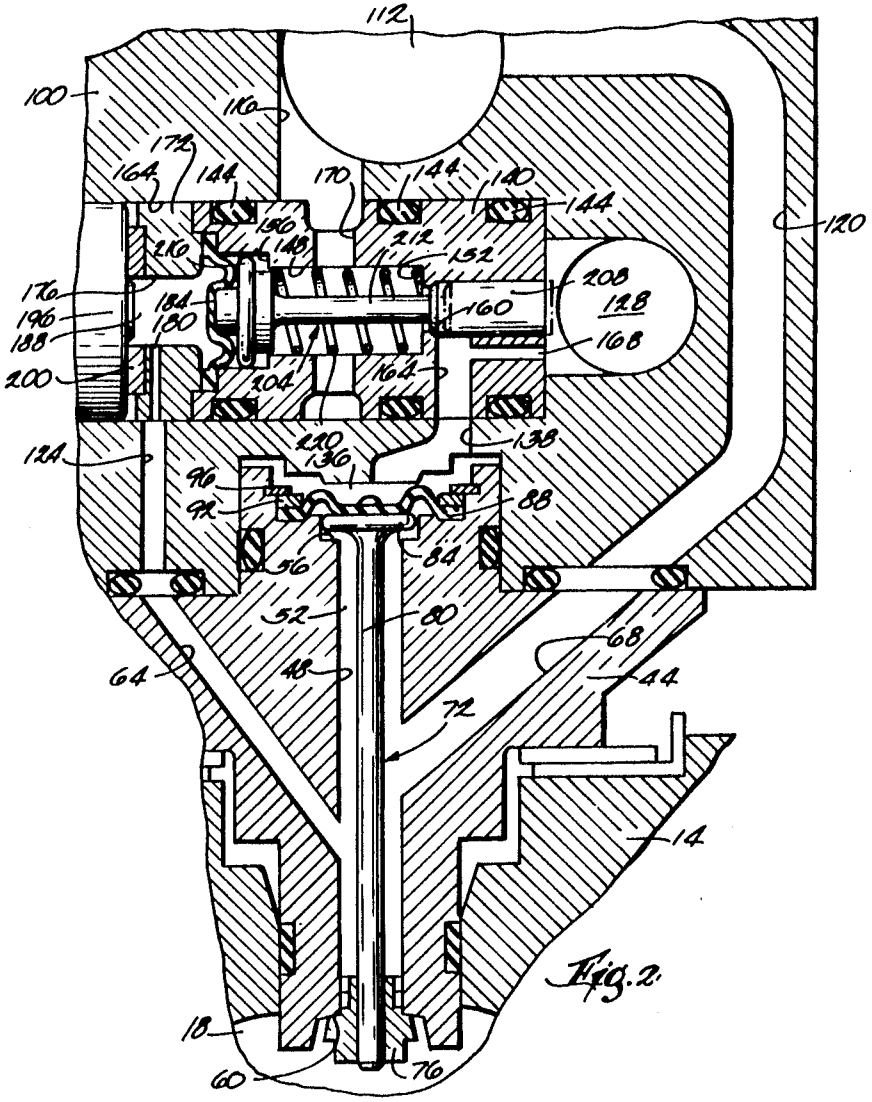
FIG. 2 is an enlarged partial view of the fuel supply apparatus shown in FIG. 1.

Before one embodiment of the invention is explained in detail, it is to be understood that the invention is not limited in its application t the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 1:
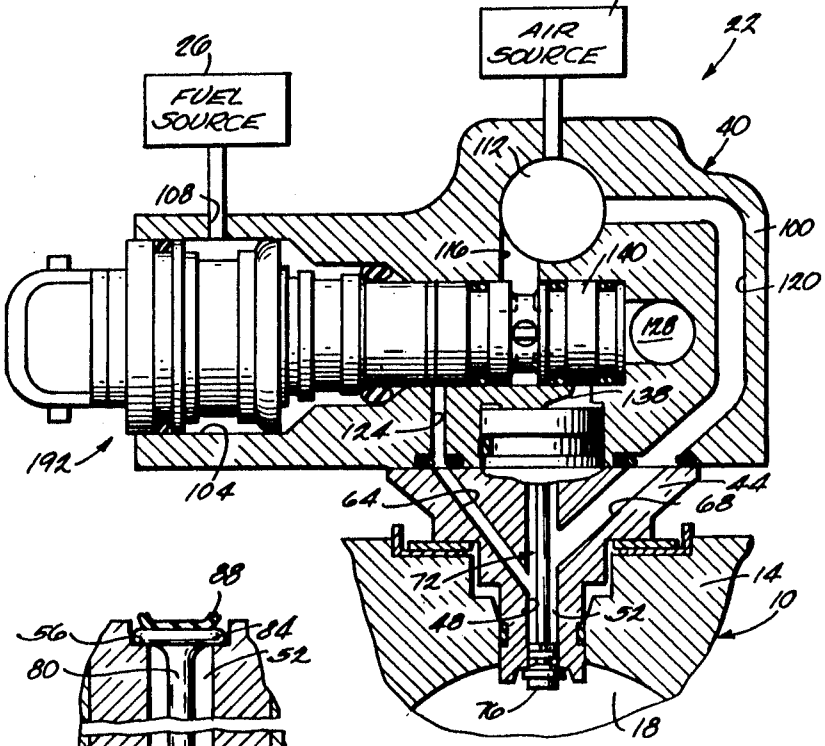
FIG. 1 is a partial sectional view of an internal combustion engine embodying the invention.
Figure 3:
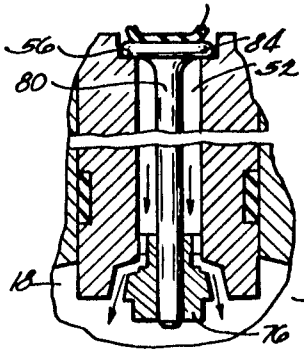
FIG. 3 is a further enlarged partial view of the fuel supply apparatus.

An internal combustion engine 10 embodying the invention is shown in FIGS. 1–3. The engine 10 is preferably a two-stroke engine and includes an engine block 14 defining a combustion chamber or cylinder 18, a crankcase (not shown), a transfer passage (not shown)

communicating between the crankcase and the combustion chamber 18, and an exhaust port (not shown) communicating with the combustion chamber 18. The engine 10 also includes a piston (not shown) moveable in the cylinder as is known in the art.

The engine 10 also comprises a fuel supply system 22 for supplying a mixture of fuel and air to the combustion chamber 18. The fuel supply system 22 communicates with a source 26 of fuel and with a source 30 of air under pressure. While any suitable air source can be used, in the preferred embodiment, the source 30 is an air compressor powered by the engine 10. The air is preferably at a pressure of approximately 80 psig. In alternative embodiments, the air source can be an accumulation chamber such as disclosed in U.S. Pat. No. 4,865,002, which is incorporated herein by reference.

The fuel supply system 22 also includes a fuel supply apparatus 40. The apparatus 40 includes (see FIGS. 1 and 2) an inner housing 44 mounted on the engine block 14. The inner housing 44 has therein a fuel/air bore 48 defining a fuel/air chamber 52 and including (see FIG. 2) a shoulder 56 and a valve seat 60 located adjacent the combustion chamber 18. The inner housing 44 also has therein a fuel passageway 64 communicating with the fuel/air chamber 52, and an air passageway 68 communicating with the fuel/air chamber 52.

The apparatus 40 also includes (see FIG. 2) a valve assembly 72 including a valve member 76 moveable into and out of engagement with the valve seat 60. When the valve member 76 engages the valve seat 60, as shown in FIG. 2, the fuel/air chamber 52 is closed to the combustion chamber 18. When the valve member 76 is out of engagement with the valve seat 60, as shown in FIG. 3, the fuel/air chamber 52 is open to the combustion chamber 18. The assembly 72 also includes (see FIG. 2) a valve stem 80 extending through the fuel/air chamber 52 and having a lower end fixedly connected to the valve member 76 and an upper end having thereon an enlarged portion or piston 84 moveable into and out of engagement with the shoulder 56. The valve member 76 is out of engagement with the valve seat 60 when the piston 84 engages the shoulder 56 (FIG. 3), and the piston 84 is out of engagement with the shoulder 56 when the valve member 76 engages the valve seat 60 (FIG. 2).

The apparatus 40 also includes (see FIG. 2) a moveable wall or diaphragm 88 having a periphery fixed to the inner housing 44 by suitable means such as a washer 92 and a retaining ring 96. The diaphragm 88 has an inner or central portion fixed to the piston 84 for common movement therewith.

The apparatus 40 also includes (see FIG. 1) an outer housing 100 mounted on the inner housing 44. The outer housing 100 has therein a main bore 104, and the outer housing 100 includes a fuel inlet 108 communicating with the bore 104 and communicating with the fuel source 26 so as to supply fuel to the bore 104. The outer housing 100 also includes an air inlet 112 communicating with the air source 30, an air passageway 116 communicating between the inlet 112 and the bore 104, and an air passageway 120 communicating between the inlet 112 and the air passageway 68, so that the fuel/air chamber 52 communicates with the air source 30. The outer housing 100 also includes a fuel supply passageway 124 communicating between the bore 104 and the fuel passageway 64 in the inner housing 44, and a vent passageway 128 communicating with the atmosphere. The outer housing 100 and the upper or outer surface of the diaphragm 88 define therebetween (see FIG. 2) an air chamber 136. The outer housing 100 also includes (see FIG. 2) a passageway 138 communicating between the bore 104 and the air chamber 136.

The apparatus 40 also includes (see FIG. 2) a valve seat member 140 housed in the bore 104. A plurality of O-rings 144 surround the valve seat member 140 and sealingly engage the housing 100. The valve seat member 140 has therein a longitudinal bore 148 including an inner shoulder 152, an outer shoulder 156 and a valve seat 160. The member 140 also includes a transverse bore 164 communicating between the longitudinal bore 148 and the passageway 138 so that the transverse bore 164 communicates with the air chamber 136. The member 140 also includes a restricted vent passageway 168 communicating between the transverse bore 164 and the vent passageway 128 in the outer housing 100. The member 140 also includes a transverse bore 170 communicating between the air passageway 116 and the bore 148. The valve seat 160 is located intermediate the bores 164 and 170.

The apparatus 40 also includes (see FIG. 2) an annular spacer 172 which is housed in the bore 104 and which abuts the outer or left end of the valve seat member 140. The spacer 172 has therethrough a central bore 176 and includes a transverse bore 180 communicating between the central bore 176 and the fuel supply passageway 124 in the outer housing 100.

The apparatus 40 also includes (see FIG. 2) a moveable wall or diaphragm 184 having a periphery captured between the spacer 172 and the member 140. The central bore 176 of the spacer 172 and the left or outer surface of the diaphragm 184 define a fuel chamber 188 which communicates with the fuel/air chamber 52 via the bore 180 and the passageways 124 and 64. The transverse bore 180 provides a fuel orifice which is spaced from the diaphragm 184 and which communicates between the fuel chamber 188 and the fuel/air chamber 52.

The apparatus 40 also includes (see FIG. 1) selectively operable means for delivering fuel under pressure to the fuel chamber 188 and thereby to the fuel/air chamber 52. While various suitable delivery means can be used, in the illustrated construction, such means includes a conventional fuel injector 192 which is housed in the bore 104, which communicates with the fuel source 26 via the fuel inlet 108, and which includes (see FIG. 2) a fuel injection nozzle 196 communicating with the fuel chamber 188. The fuel injector 192 preferably supplies fuel at approximately 100 psig. A suitable seal 200 is located between the fuel injector 192 and the spacer 172.

The apparatus 40 also includes (see FIG. 2) a valve assembly 204 including a valve member 208 which is slidably housed in the inner end of the bore 148 and which is moveable into and out of engagement with the valve seat 160. The air source 30 communicates via the inlet 112, the passageway 116, and the bores 170 and 148 with the transverse bore 164 (and thereby with the air chamber 136) when the valve member 208 is out of engagement with the valve seat 160, as shown in phantom in FIG. 2, and the valve member 208 prevents communication between the air source 30 and the air chamber 136 when the valve member 208 engages the valve seat 160, as shown in solid lines in FIG. 2. The assembly 204 also includes a valve stem 212 having a right or inner end fixed to the valve member 208 and having a left or outer end having thereon an enlarged portion or piston 216 which engage the diaphragm 184 and which is moveable into and out of engagement with the outer shoulder 156. The piston 216 is out of engagement with the shoulder 156 when the valve member 208 engages the valve seat 160, and the valve member 208 is out of engagement with the valve seat 160 when the piston 216 engages the shoulder 156.

The apparatus 140 also includes means for biasing the valve member 208 into engagement with the valve seat 160 or for biasing the piston 216 out of engagement with the shoulder 156 or for biasing the diaphragm 184 in the direction decreasing the volume of the fuel chamber 188. While various suitable biasing means can be employed, in the illustrated construction, such means includes (see FIG. 2) a spring 220 extending between the piston 216 and the inner shoulder 152.

When the valve member 208 engages the valve seat 160, the air chamber 136 is vented to atmosphere (via passageways 138, 164, 168, and 128) and is therefore at atmospheric pressure. Meanwhile, the fuel/air chamber 52 and the fuel chamber 188 are at a pressure of approximately 80 psig due to communication with the air source 30. Therefore, a pressure of approximately 80 psig acts on the left side of the diaphragm 184, and the same pressure acts on the right side of the diaphragm 184 because the portion of the bore 148 in which the piston 216 is located communicates with the air source 30 via the bore 170 and the passageway 116. Thus, the net pressure force exerted on the diaphragm 184 is zero, and the force of the spring 220 maintains the valve member 208 in engagement with the valve seat 160.

The apparatus 40 also includes discharge means which communicates with the air source 30 and which is selectively operable for delivering a fuel/air mixture to the combustion chamber 18. While various suitable discharge means can be used, in the illustrated construction, such means includes the fuel/air chamber 52, the air chamber 136, the fuel chamber 188, and means for opening the fuel/air chamber 52 to the combustion chamber 18 in response to communication of the air chamber 136 with the air source 30. While various suitable means can be used for opening the fuel/air chamber 52, in the illustrated construction, such means includes the diaphragm 88 and the valve assembly 72. The manner in which these elements open the fuel/air chamber 52 is described below.

The apparatus 40 also includes means for effecting operation of the discharge means in response to operation of the fuel injector 192. While various suitable means can be used, in the illustrated construction, the means for effecting operation of the discharge means includes means for effecting communication between the air chamber 136 and the air source 30 in response to the delivery of fuel to the fuel chamber 188. While various suitable means can be employed for effecting communication between the chambers, in the illustrated construction, such means includes the diaphragm 184 and the valve assembly 204.

The force exerted on the diaphragm 184 by fuel pressure from the fuel injector 192 is such that the valve member 208 moves to the right and out of engagement with the valve seat 160 in response to injection of fuel into the fuel chamber 188 and against the diaphragm 184. In other words, the fuel injector 192 constitutes selectively operable means for supplying fuel to the fuel chamber 188 at a pressure sufficient to move the diaphragm 84 in the direction increasing the volume of the fuel chamber 188. As a result, the air chamber 136 is opened to the air source 30 via the air inlet 112, the passageway 116, the bores 170, 148 and 164, and the passageway 138 in response to fuel injection. Furthermore, the valve assembly 204 constitutes means for effecting communication between the air chamber 136 and the air source 30 in response to movement of the diaphragm 184 in the direction increasing the volume of the fuel chamber 188.

The area of the piston 84 exposed to the fuel/air chamber 52 is greater than the area of the valve member 76 exposed to the fuel/air chamber 52. Therefore, when the valve member 208 is seated and the air chamber 136 is at atmospheric pressure, the air in the fuel/air chamber 52 maintains the valve member 76 in engagement with the valve seat 60.

When the valve member 208 moves out of engagement with the valve seat 160 so as to open the air chamber 136 to the air source 30, the pressure in the air chamber 136 almost instantaneously becomes 80 psig. Since the air pressure in the air chamber 52 is also 80 psig, the net pressure force acting on the diaphragm 88 becomes zero. Now, the force of the air pressure in the chamber 52 acting on the exposed area of the valve member 76 is sufficient to move the diaphragm 88 and the valve assembly 72 downwardly so as to move the valve member 76 out of engagement with the valve seat 60 and thereby open the fuel/air chamber 52 to the combustion chamber 18. As a result, a atomized mixture of fuel and air is delivered to the combustion chamber 18.

Alternatively stated, the apparatus 40 includes means for opening the fuel/air chamber 52 to the combustion chamber 18 in response to movement of the diaphragm 184 in the direction increasing the volume of the fuel chamber 188. While various suitable means can be employed, in the illustrated construction, such means includes the air chamber 136, the valve assembly 72, the diaphragm 184, and the valve assembly 204.

Figure 4:
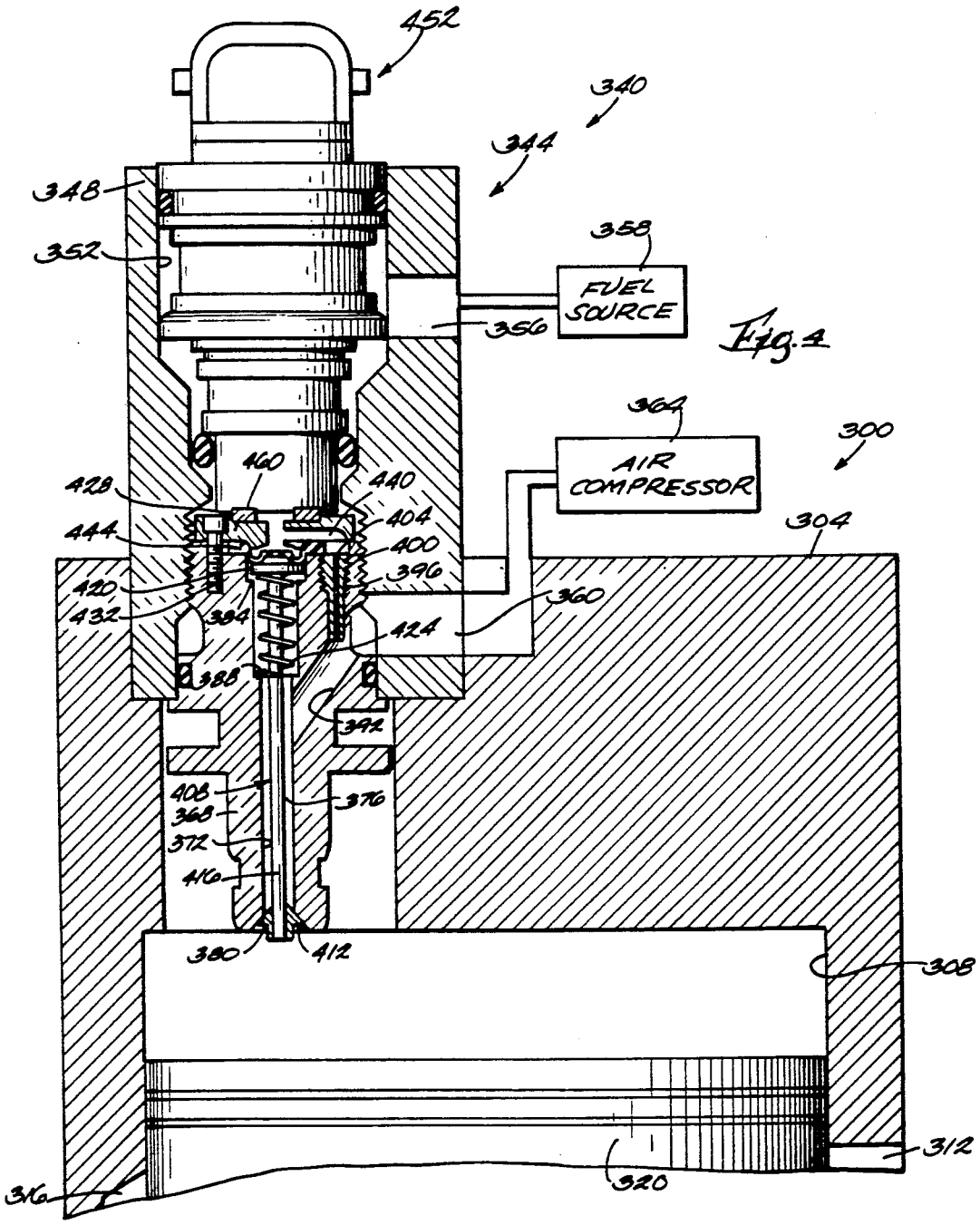
FIG. 4 is a partial sectional view of an internal combustion engine that is an alternative embodiment of the invention.
Figure 5:
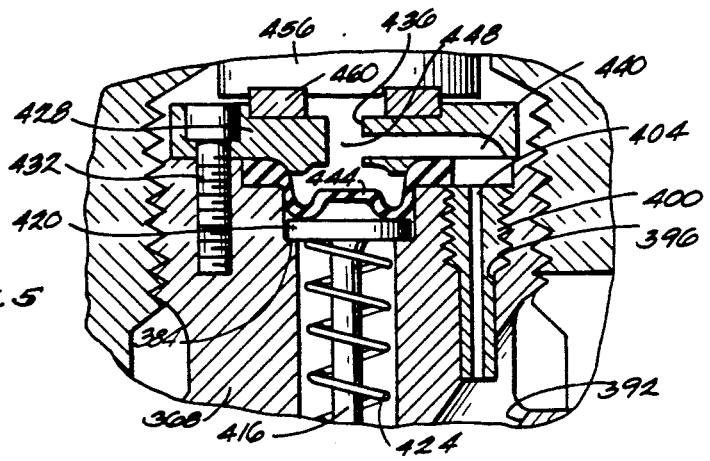
FIG. 5 is an enlarged partial view of the fuel supply apparatus shown in FIG. 4.

An internal combustion engine 300 that is an alternative embodiment of the invention is illustrated in FIGS. 4 and 5. The engine 300 is preferably a two-stroke engine and includes an engine block 304 defining a combustion chamber or cylinder 308 and a crankcase (not shown). The engine block 304 includes an exhaust port 312 and an inlet port 316, both of which communicate with the cylinder 308. The engine 300 also includes a piston 320 moveable in the cylinder 308 as is known in the art.

The engine 300 also comprises a fuel supply apparatus 340. The apparatus 340 includes (see FIG. 4) a housing 344 mounted on the engine block 304. The housing 344 includes a first or upper portion 348 having therein a bore 352. The upper housing portion 348 also has therein a fuel inlet 356 communicating between the bore 352 and a source 358 of fuel. The upper portion 348 also has therein an air inlet 360 communicating with the bore 352 and communicating with a suitable source 364 of air under pressure, such as the air source 30 of the abovedescribed engine 10. The housing 344 also includes a second or lower portion 368 connected to the upper portion 348. Preferably, the lower portion 368 is threaded into the lower end of the bore 352. The lower portion 368 has therein a longitudinal bore 372 defining a fuel/air chamber 376. The bore 372 includes a valve seat 380, an upper shoulder 384, and a lower shoulder 388. The lower portion 368 also has therein an air passageway 392 communicating between the fuel/air chamber 376 and the air inlet 360, so that the fuel/air chamber 376 communicates with the air source 364. The lower housing portion 368 also has therein (see FIG. 5) a bore 396 which is parallel to and spaced from the bore 372 and which extends from the upper end of the housing portion 368 to the air passageway 392.

The apparatus 340 also includes (see FIG. 5) an orifice member 400 housed in the bore 396. Preferably, the member 400 is threaded into the bore 396. The member 400 has therethrough a fuel flow control orifice 404 extending from the upper end of the housing portion 368 and communicating with the air passageway 392.

The apparatus 340 also includes (see FIG. 4) a valve assembly 408 including valve member 412 moveable into and out of engagement with the valve seat 380. When the valve member 412 engages the valve seat 380, as shown in FIG. 4, the fuel/air chamber 376 is closed to the combustion chamber 308. When the valve member 412 is out of engagement with the valve seat 380, the fuel/air chamber 376 is open to the combustion chamber 308. The assembly 408 also includes a valve stem 416 extending through the fuel/air chamber 376 and having a lower end fixedly connected to the valve member 412 and an upper end having thereon an enlarged portion or piston 420 moveable into and out of engagement with the shoulder 384. The valve member 412 is out of engagement with the valve seat 380 when the piston 420 engages the shoulder 384, and the piston 420 is out of engagement with the shoulder 384 when the valve member 412 engages the valve seat 380.

The apparatus 340 also includes means for biasing the valve member 412 into engagement with the valve seat 380 or for biasing the piston 420 out of engagement with the shoulder 384. While various suitable biasing means can be employed, in the illustrated construction, such means includes a spring 424 extending between the piston 420 and the shoulder 388.

The apparatus 340 also includes (see FIG. 5) an annular spacer 428 which is housed in the bore 352 and which is connected to the upper end of the lower housing portion 368 by suitable means such as a screw 432. The spacer 428 has therethrough a central bore 436 and also has therein a fuel flow channel or passageway 440 communicating between the central bore 436 and the fuel flow control orifice 404.

The apparatus 340 also includes a moveable wall or diaphragm 444 having a periphery fixed to the housing 344 and having an inner or central portion engaging the piston 420 such that downward movement of the diaphragm 444 causes downward movement of the piston 420. In the illustrated construction, the periphery of the diaphragm 444 is captured between the spacer 428 and the upper end of the lower housing portion 368. The diaphragm 444 is located such that the orifice 404 is spaced from the diaphragm 444. The upper surface of the diaphragm 444 and the central bore 436 of the spacer 428 define (see FIG. 5) a fuel chamber 448.

The apparatus 340 also includes selectively operable means for supplying fuel to the fuel chamber 448 at a pressure sufficient to move the diaphragm 444 downwardly or in the direction increasing the volume of the fuel chamber 448. While various suitable means can be used, in the illustrated construction, such means includes (see FIG. 4) a conventional fuel injector 452 which is housed in the bore 352, which communicates with the fuel source 358 via the fuel inlet 356, and which includes (see FIG. 5) a fuel injection nozzle 456 communicating with the fuel chamber 448. A suitable seal 460 is located between the fuel injector 452 and the spacer 428. The fuel injector 452 preferably supplies fuel at approximately 100 psig. The force exerted on the diaphragm 444 by fuel pressure from the fuel injector 452 is such that the valve member 412 moves out of engagement with the valve seat 380 in response to injection of fuel into the fuel chamber 448 and against the diaphragm 444.

The apparatus 340 also includes means for opening the fuel/air chamber 376 to the combustion chamber 308 in response to movement of the diaphragm 444 in the direction increasing the volume of the fuel chamber 448. While various suitable means can be employed, in the illustrated construction, such means includes means for moving the valve member 412 out of engagement with the valve seat 380 in response to movement of the diaphragm 444 in the direction increasing the volume of the fuel chamber 448. Preferably, this means includes means connecting the diaphragm 444 to the valve member 412. Such connecting means preferably includes the piston 420 and the valve stem 416.

The valve member 412 is normally held against the valve seat 380 by the spring 424, and the fuel/air chamber 376 communicates with the air source 364 via the air passageway 392 and the air inlet 360. When the fuel injector 452 discharges fuel against the diaphragm 444, the diaphragm 444 moves downwardly and acts through the piston 420 and the stem 416 to move the valve member 412 out of engagement with the seat 380 and thereby open the fuel/air chamber 376 to the combustion chamber 308. The fuel flow channel 440 and the orifice 404 provide a controlled leak path for fuel to flow from the fuel chamber 448 to the air passageway 392 and thus to the fuel/air chamber 376. A finely atomized spray of fuel and air is discharged from the fuel/air chamber 376 to the combustion chamber 308. When the fuel injector 452 is turned off, the spring 424 returns the valve member 412 to its closed position. Thus, air/fuel flow to the combustion chamber 308 coincides with fuel injector flow.

Increasing the size of the orifice 404 increases the fuel flow rate, and decreasing the size of the orifice 404 decreases the fuel flow rate. Flow rate consistency with different fuel injectors is obtained by maintaining a tight tolerance in the orifice size. A proper flow rate is achieved by proper orifice size selection.

Various features of the invention are set forth in the following claims.

We claim:

1. An internal combustion engine comprising means defining a combustion chamber, means defining a fuel/air chamber adapted to communicate with a source of air under pressure, means including a moveable wall defining a fuel chamber, selectively operable means for supplying fuel to said fuel chamber at a pressure sufficient to move said wall in the direction increasing the volume of said fuel chamber, means defining a fuel orifice which is spaced from said wall and which communicates between said fuel chamber and said fuel/air chamber, and means for opening said fuel/air chamber to said combustion chamber in response to movement of said wall in the direction increasing the volume of said fuel chamber.

2. An engine as set forth in claim 1 and further comprising a housing having therein a bore and including an air passageway which communicates with said fuel/air chamber and which is adapted to communicate with the source of air, and a fuel flow passageway communicating with said fuel chamber, and wherein said fuel orifice is spaced from said bore and communicates between said fuel flow passageway and said air passageway.

3. An engine as set forth in claim 1 and further comprising means for biasing said wall in the direction minimizing the volume of said fuel chamber.

4. An engine as set forth in claim 1 and further comprising means defining a valve seat, and a valve member moveable into and out of engagement with said valve seat, and wherein said means for opening said fuel/air chamber to said combustion chamber includes means for moving said valve member out of engagement with said valve seat in response to movement of said wall in the direction increasing the volume of said fuel chamber.

5. An engine as set forth in claim 4 wherein said means for moving said valve member includes means connecting said wall to said valve member.

6. An engine as set forth in claim 1 wherein fuel flow from said fuel supplying means exerts on said wall a force sufficient to move said wall in the direction increasing the volume of said fuel chamber.

7. An engine as set forth in claim 1 wherein said means for opening said fuel/air chamber includes means defining an air chamber, means for opening said fuel/air chamber to said combustion chamber in response to communication of said air chamber with the air source, and means for effecting communication between said air chamber and the air source in response to movement of said wall in the direction increasing the volume of said fuel chamber.

8. An engine as set forth in claim 7 wherein said air chamber communicates with the atmosphere.

9. An engine as set forth in claim 7 and further comprising means defining a valve seat, and a valve member moveable into and out of engagement with said valve seat, and wherein said means for effecting communication between said air chamber and the air source includes means for moving said valve member out of engagement with said valve seat.

10. An engine as set forth in claim 9 wherein said means for effecting communication between said air chamber and the air source further includes means for moving said valve member out of engagement with said valve seat in response to movement of said wall in the direction increasing the volume of said fuel chamber.

11. An engine as set forth in claim 10 and further comprising means for biasing said wall in the direction decreasing the volume of s id fuel chamber.

12. An engine as set forth in claim 7 and further comprising means defining a valve seat, and a valve member moveable into and out of engagement with said valve seat, and wherein said means for opening said fuel/air chamber includes means for moving said valve member out of engagement with said valve seat.

13. An engine as set forth in claim 12 wherein said means for opening said fuel/air chamber further includes a second moveable wall partially defining said air chamber, and means for moving said valve member out of engagement with said valve seat in response to movement of said wall in the direction increasing the volume of said air chamber.

14. An internal combustion engine comprising means defining a combustion chamber, means defining a fuel/air chamber adapted to communicate with a source of air under pressure, means defining an air chamber, means for opening said fuel/air chamber to said combustion chamber in response to communication of said air chamber with the air source, means for effecting communication between said air chamber and the air source in response to delivery of fuel to said fuel/air chamber, and selectively operable means for delivering fuel to said fuel/air chamber.

15. An engine as set forth in claim 14 and further comprising means defining a fuel chamber communicating with said fuel/air chamber, wherein said fuel delivery means delivers fuel to said fuel chamber, and wherein said means for effecting communication between said air chamber and the air source operates in response to delivery of fuel to said fuel chamber.

16. An engine as set forth in claim 14 wherein said air chamber communicates with the atmosphere.

17. An engine as set forth in claim 14 and further comprising means defining a valve seat, and a valve member moveable into and out of engagement with said valve seat, and wherein said means for effecting communication between said air chamber and the air source includes means for moving said valve member out of engagement with said valve seat.

18. An engine as set forth in claim 17 wherein said means for effecting communication between said air chamber and the air source further includes a moveable wall partially defining said fuel chamber, and means for moving said valve member out of engagement with said valve seat in response to movement of said wall in the direction increasing the volume of said fuel chamber.

19. An engine as set forth in claim 18 and further comprising means for biasing said wall in the direction decreasing the volume of said fuel chamber.

20. An engine as set forth in claim 14 and further comprising means defining a valve seat, and a valve member moveable into and out of engagement with said valve seat, and wherein said means for opening said fuel/air chamber includes means for moving said valve member out of engagement with said valve seat.

21. An engine as set forth in claim 20 wherein said means for opening said fuel/air chamber further includes a moveable wall partially defining said air chamber, and means for moving said valve member out of engagement with said valve seat in response to movement of said wall in the direction increasing the volume of said air chamber.

22. A fuel supply system for an internal combustion engine including a combustion chamber, said system comprising means defining a fuel/air chamber adapted to communicate with a source of air under pressure, means including a moveable wall defining a fuel chamber, selectively operable means for supplying fuel to said fuel chamber at a pressure sufficient to move said wall in the direction increasing the volume of said fuel chamber, means defining a fuel orifice which is spaced from said wall and which communicates between said fuel chamber and said fuel/air chamber, and means for opening said fuel/air chamber to the combustion chamber in response to movement of said wall in the direction increasing the volume of said fuel chamber.

23. A fuel supply system for an internal combustion engine including a combustion chamber, said system comprising means defining a fuel/air chamber adapted to communicate with a source of air under pressure, means defining an air chamber, means for opening said fuel/air chamber to the combustion chamber in response to communication of said air chamber with the air source, means for effecting communication between said air chamber and the air source in response to delivery of fuel to said fuel/air chamber, and selectively operable means for delivering fuel to said fuel/air chamber.

24. A fuel supply system for an internal combustion engine including a combustion chamber, said system comprising means defining a fuel/air chamber adapted to communicate with a source of air under pressure, means defining a first valve seat, a first valve member moveable into and out of engagement with said first valve seat, a first moveable wall partially defining an air chamber, and means for opening said fuel/air chamber to the combustion chamber in response to communication of said air chamber with the air source, said means for opening said fuel/air chamber including means for moving said first valve member out of engagement with said first valve seat in response to movement of said first wall in the direction increasing the volume of said air chamber, said system also comprising means defining a second valve seat, a second valve member moveable into and out of engagement with said second valve seat, a second moveable wall partially defining a fuel chamber communicating with said fuel/air chamber, and means for effecting communication between said air chamber and the air source in response to delivery of fuel to said fuel chamber, said means for effecting communication between said air chamber and the air source including means for moving said second valve member out of engagement with said second valve seat in response to movement of said second wall in the direction increasing the volume of said fuel chamber, and said system also comprising selectively operable means for delivering fuel to said fuel chamber.

* * * * *